US005370293A

United States Patent [19]

Bevins

[11] Patent Number: 5,370,293

[45] Date of Patent: Dec. 6, 1994

[54] HAND TOOL FOR APPLYING FASTENING MEMBERS

[76] Inventor: Joseph F. Bevins, 378 Main St., Schoharie, N.Y. 12157

[21] Appl. No.: 110,716

[22] Filed: Aug. 23, 1993

[51] Int. Cl.[5] ..... B25C 1/02

[52] U.S. Cl. ..... 227/63; 227/78; 227/147

[58] Field of Search ..... 227/147, 140, 78, 63

[56] References Cited

U.S. PATENT DOCUMENTS

| | | | |
|---|---|---|---|
| 350,420 | 10/1886 | Dillon | 227/147 X |
| 462,565 | 11/1891 | Lewis | 227/78 X |
| 1,106,241 | 8/1914 | Richardson | 227/147 |
| 3,180,550 | 4/1965 | Boynton et al. | 227/147 X |
| 4,263,903 | 4/1981 | Griggs | 227/147 X |
| 4,390,050 | 6/1983 | Whitney | 227/147 X |
| 4,903,882 | 2/1990 | Long | 227/147 |
| 5,163,597 | 11/1992 | Napoli, Jr. et al. | 227/147 X |

*Primary Examiner*—Rinaldi I. Rada
*Attorney, Agent, or Firm*—Hugh E. Smith

[57] ABSTRACT

A hand tool for applying fastening members into a supporting surface to secure an elongated object, such as a wire or cable, into the supporting surface. The tool comprises a rectangular, L-shaped body with a contact portion at each end comprising a U-shaped channel for receiving and supporting fastening members. The L-shaped end of the tool is adapted for striking to cause the fastening member to be pushed into the supporting surface. The tool allows the user complete visibility of the fastening member throughout the fastening process. The tool may also include a slide hammer assembly coupled in an intermediate portion of the body to provide a striking mechanism for the tool and a rod may extend beyond the L-shaped end to form a tapered, upwardly curving point for removing fastening members.

3 Claims, 5 Drawing Sheets

FIG. 7
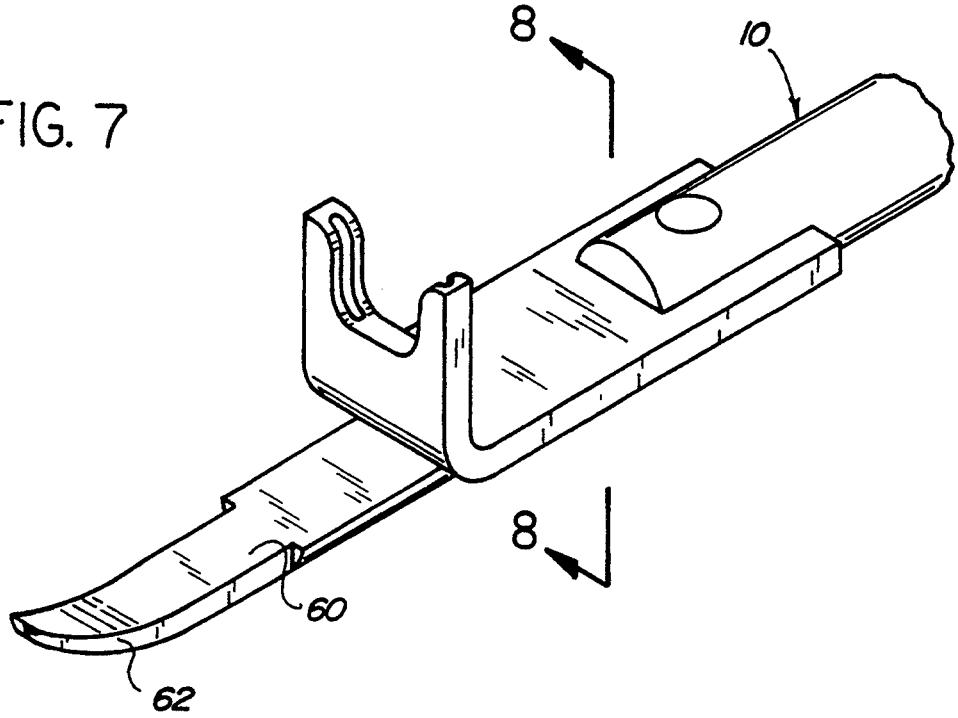
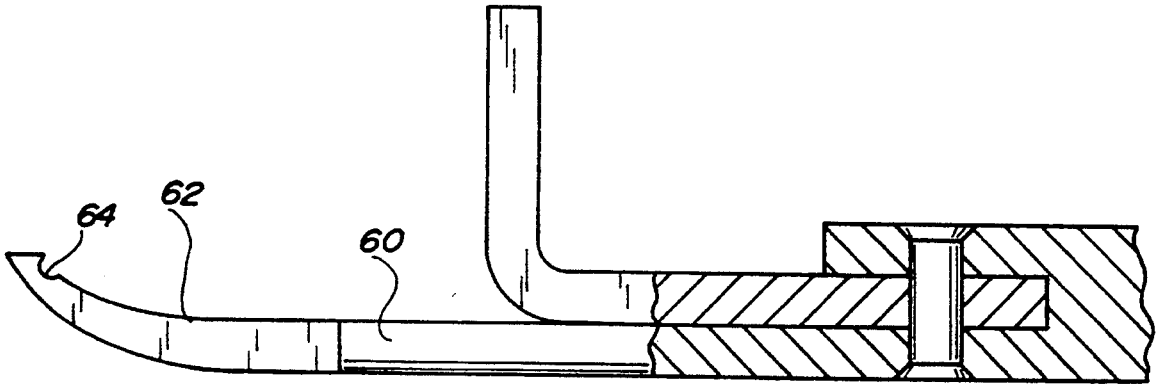
FIG. 8

HAND TOOL FOR APPLYING FASTENING MEMBERS

BACKGROUND OF THE INVENTION

1. Field of the Invention

The present invention relates to hand tools and more particularly pertains to a hand tool for applying fastening members which may be used to secure an elongated object to a supporting surface by striking the tool while allowing a user complete visibility of the fastening member throughout fastening process.

2. Description of the Prior Art

The use of hand tools is known in the prior art. More specifically, hand tools heretofore devised and utilized for the purpose of applying fastening members into a supporting surface are known to consist basically of familiar, expected and obvious structural configurations, notwithstanding the myriad of designs encompassed by the crowded prior art which have been developed for the fulfillment of countless objectives and requirements.

The present invention is directed to improving devices for applying fastening members in a manner which is safe, secure, economical and aesthetically pleasing.

Fastener tools are widely used in many diverse applications for securing fasteners into many different types of workpieces. A typical fastener tool includes a tool body enclosing a power system for driving a fastener into a support surface. Such a tool is shown and described in U.S. Pat. No. 5,052,607 and includes a pointing device to permit the tool to be positioned against a support surface so that a fastener is driven precisely at a target point.

Another example of a fastener tool is described in U.S. Pat. No. 4,709,842 that comprises a feed device that feeds a succession of fasteners towards a determined mounting position. The tool also has a driving device which drives the fastener into the support surface.

A further patent of interest is U.S. Pat. No. 5,094,380 which relates to fastener driving tools and includes a guide formed as a rigid member for locating a position on a support surface. The guide also controls the degree of penetration of the fastener into the support surface.

Additionally, U.S. Pat. No. 5,014,897 describes a staple gun driver guide assembly which is aligned with the fastener driving mechanism. A fastener magazine holds and feeds fasteners to the fastener guide assembly. The fastener guide assembly helps position a fastener laterally and longitudinally on a support surface.

Other relevant patents include U.S. Pat. No. 4,417,683.

Drawbacks of the prior art tools comprise lack of visibility of the fastening member during the fastening process, a heavier tool due to the typical size of the tool, and less ability to place the tool in smaller spaces and in various directions.

Another method of applying fastener members is to hold the fastening member with the fingers and drive it into a supporting surface with a tool such as a hammer. However, this method obscures the fastening member and renders the fingers vulnerable to injury.

In this respect, the hand tool for applying fastening members according to the present invention substantially departs from the conventional concepts and designs of the prior art, and in so doing provides an apparatus primarily developed for the purpose of applying fastening members.

Therefore, it can be appreciated that there exists a continuing need for new and improved fastening device which can be applying fastening members. In this regard, the present invention substantially fulfills this need.

As illustrated by the background art, efforts are continuously being made in an attempt to improve on fastener devices. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of component elements, with the use of a minimum number of functioning parts, at a reasonable cost to manufacture, and by employing only readily available materials.

SUMMARY OF THE INVENTION

In view of the foregoing disadvantages inherent in the known types of hand tools now present in the prior art, the present invention provides an improved hand tool for applying fastening members construction wherein the same can be utilized for applying fastening members. As such, the general purpose of the present invention, which will be described subsequently in greater detail, is to provide a new and improved hand tool for applying fastening members apparatus and method which has many of the advantages of the prior art hand tools and few of the disadvantages.

The invention is defined by the appended claims with the specific embodiment shown in the attached drawings. For the purpose of summarizing the invention, the invention may be incorporated into a new and improved hand tool for applying a fastening member. The hand tool comprises a rectangular, L-shaped member having each end adapted for receiving and securing a fastening member. Each end also being adapted for placement against a support surface, such as a wooden beam, to secure an elongated object, such as a cable. To drive the fastening member into the support surface, a device such as a hammer is used to strike the L-shaped end of the tool.

An alternate embodiment of the invention comprises a slide hammer assembly located in the intermediate portion of the tool. The slide hammer assembly provides for a fast, safe way of driving the fastening member into the support surface.

In a further embodiment of the invention, the tool includes an additional piece that allows for grasping and removing a fastening member.

In a still further embodiment of the invention, the tool comprises a removeably secured contact portion formed of various sizes adapted for use with a variety of fastening members.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved hand tool for applying a fastening member into a supporting surface so as to fasten an elongated object, such as a wire or cable, on the supporting surface with the tool allowing the user complete visibility of the fastening member throughout the fastening process.

One object of the present invention is to provide complete visibility of the fastening member during the fastening process allowing for precise placement of the fastening member on the support surface, securing an elongated object such as a cable and further prevents a puncture to the elongated object.

A further object of the present invention is to provide a tool in light weight form and of a relatively small size. This promotes ease in handling, allows for placing the tool in smaller spaces, and is versatile in that the tool can be placed in any desired direction on the support surface.

It is therefore an additional object of the present invention to provide a new and improved hand tool for applying fastening members which has all the advantages of the prior art hand tools for applying fastening members and few of the disadvantages.

It is another object of the present invention to provide a new and improved hand tool for applying fastening members which may be easily and efficiently manufactured and marketed.

It is a further object of the present invention to provide a new and improved hand tool for applying fastening members which is of a durable and reliable construction.

An even further object of the present invention is to provide a new and improved hand tool for applying fastening members which is susceptible of a low cost of manufacture with regard to both materials and labor, and which accordingly is then susceptible of low prices of sale to the consuming public, thereby making such hand tools for applying fastening members economically available to the buying public.

Still yet another object of the present invention is to provide a new and improved hand tool for applying fastening members which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a partial perspective view of the tool in FIG. 5 showing a further alternate embodiment of the present invention comprising a fastening member removal mechanism presented.

FIG. 8 is a cross sectional view of the tool as shown in FIG. 7 of the present invention.

DESCRIPTION OF THE PREFERRED EMBODIMENT

Figure 1:
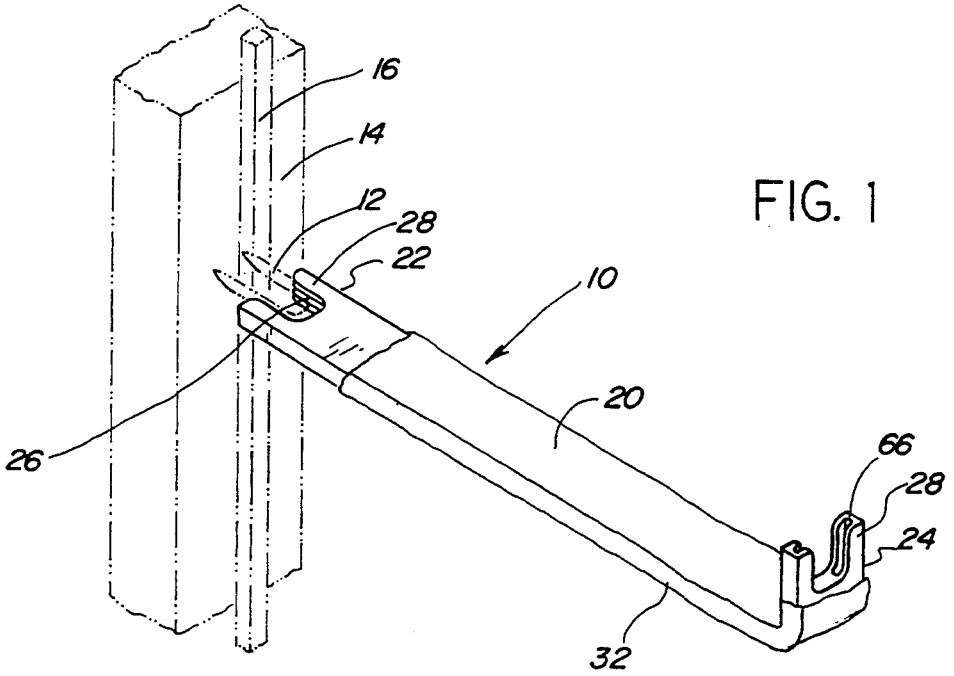
FIG. 1 is a perspective view showing the preferred embodiment of a hand tool for applying fastening members comprising the present invention.
Figure 2:
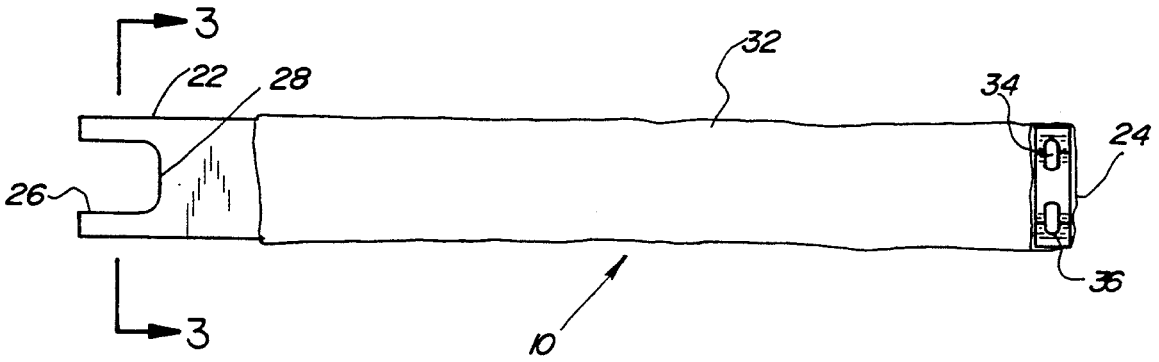
FIG. 2 is a top plan view of the tool as shown in FIG. 1 of the present invention.

With reference now to the drawings, and in particular to FIG. 1 thereof, a new and improved hand tool embodying the principles and concepts of the present invention and generally designated by the reference numeral 10 will be described.

From an overview standpoint, FIG. 1 shows the fastener tool 10 which is employed to apply fasteners 12 into a supporting surface 14 so as to secure an elongated object 16, such as a wire or cable, on the supporting surface 14. The tool allows the user complete visibility of the fastening member 12 during the fastening process.

More specifically, the fastener tool 10 comprises a rectangular L-shaped member 20. The member has a first end 22 and a second end 24. Each end forms a contact portion 28 for engaging the fastening member. Furthermore, each end comprises a U-shaped channel 26, 66 that receives and holds the fastening member 12. Typically the fastening member is a conventional staple. The staple is placed within the recess and thereafter against a support surface 14, such as a wooden beam, for securing an elongated object.

The L-shaped member 20 facilitates the user striking the fastening member with a device, such as a hammer, to propel the tool toward the support surface securing the fastening member into the support surface.

Figure 4:
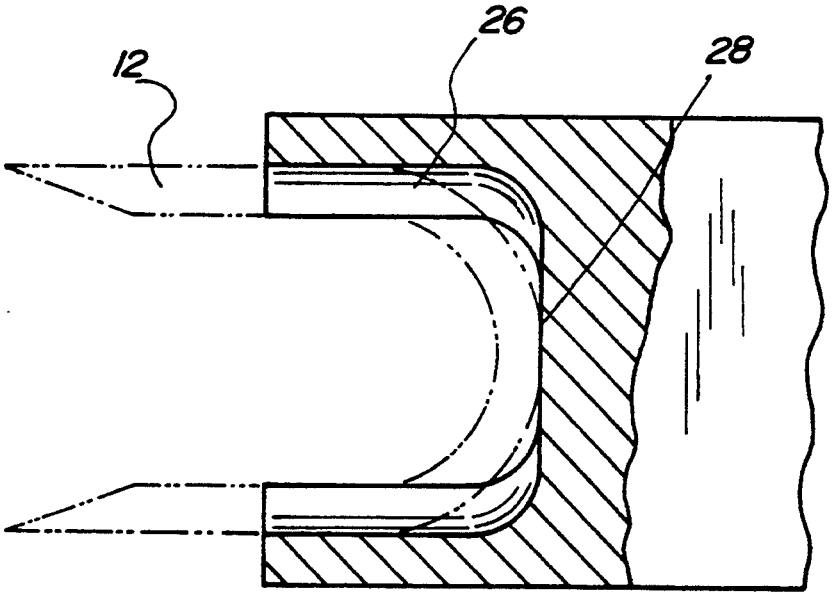
FIG. 4 is an enlarged partial cross-section showing a fastening member received and supported by a U-shaped channel of the present invention.

As shown in FIG. 4, the user places the fastening member in the U-shaped channel 26 and, subsequently, places the elongated object 16 within a space defined by the fastening member. The user, while holding the tool with one hand, strikes the L-shaped member with a device, such as a hammer, to drive the fastening member into the support surface to thereby secure the elongated object to the support surface. The tool may then be removed and the process repeated. The tool allows the user to drive the fastening member in any desired orientation into the support surface while allowing the user complete visibility of the fastening member throughout the fastening process.

The fastener tool 10 is made with predetermined length, width, and thickness. Further, the fastener tool is coated with an insulating material 32 to prevent electrical shock and to dampen vibrations. Preferably, the rectangular, L-shaped member is made of a hard and rigid material, such as steel, and measures 8" long by 1" wide by $\frac{1}{4}$" thick.

Figure 3:
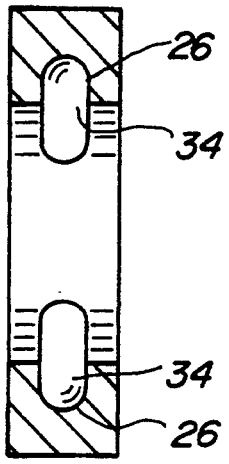
FIG. 3 is an enlarged top plan view showing each end of the present invention.

Furthermore, FIG. 3 illustrates the U-shaped channels 26. Preferably, the U-shaped channels are formed as two $\frac{1}{8}$" diameter semi-circular holes 34 drilled longitudinally through each end of the tool and having a $\frac{3}{4}$" spacing across their outboard edges 36.

FIG. 4 is an enlarged partial cross-section of FIG. 1 showing an end of the tool with a fastening member in place. The U-shaped channel is drilled to a depth of $\frac{5}{8}$" forming a $\frac{1}{2}$" slot straddled by two semi-circular holes.

Figure 5:
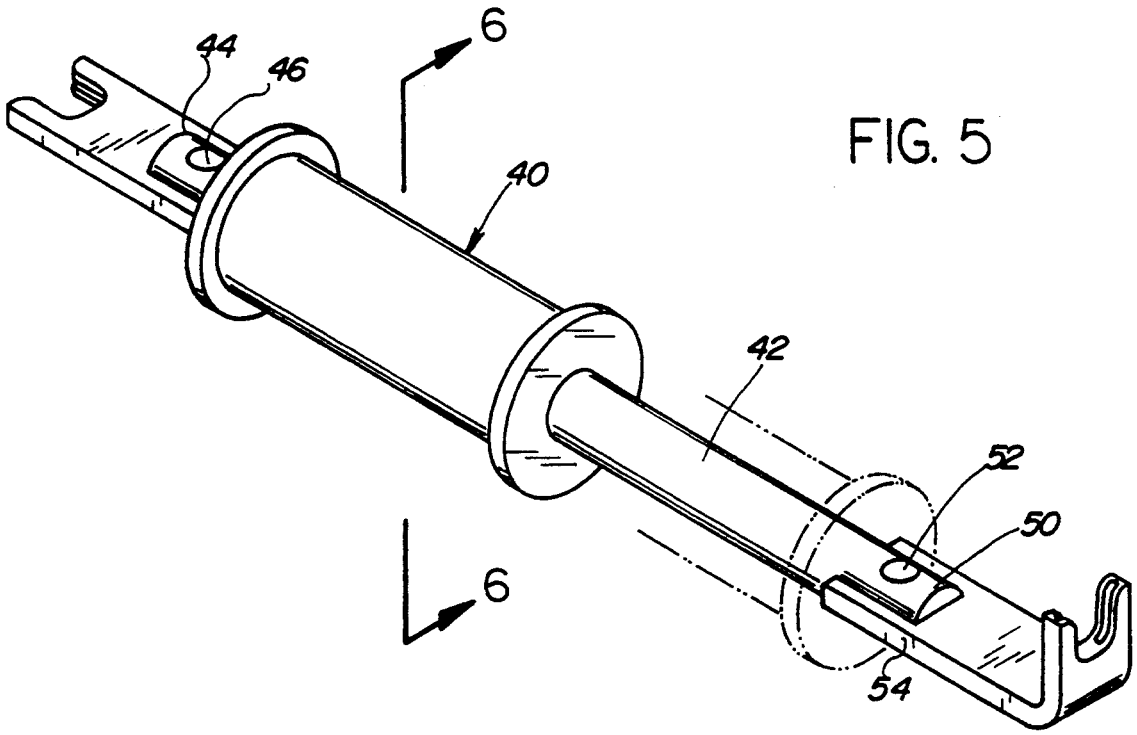
FIG. 5 shows an alternate embodiment of the present invention comprising a slide hammer assembly.
Figure 6:
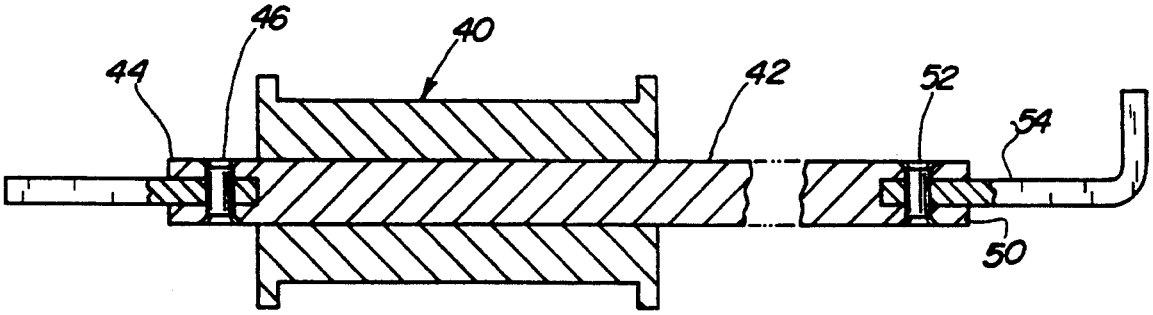
FIG. 6 is a cross-sectional side view of the tool in FIG. 5 of the present invention.

In an alternate embodiment of the fastener tool 10, the L-shaped member 20 includes a slide hammer assembly 40. See FIG. 5. The slide hammer assembly comprises a rod 42 having a first end 44 coupled by a bolt 46 to the first end of the L-shaped member. A second end 50 of the rod is coupled by a bolt 52 to an intermediate portion 54 of the L-shaped member. The slide hammer assembly is operably positioned about the rod 42 for longitudinal movement therealong. The slide hammer provides a faster, safer way for the user to propel the fastener tool forward, thus securing the fastening member into a support surface. See FIG. 6.

In a further alternate embodiment, the tool comprises a fastening member removal piece 60. FIG. 7 is a partial perspective view of the second end of the fastening tool showing the further alternate embodiment. The removal piece is formed at the second end of the rod such that the rod extends beyond the L-shaped member to form a tapered upwardly curving point 62.

FIG. 8 is a cross sectional view of FIG. 7 showing the upwardly curving point 62. The point comprising a notch 64 to help with grasping and removing a fastening member.

Figure 9:
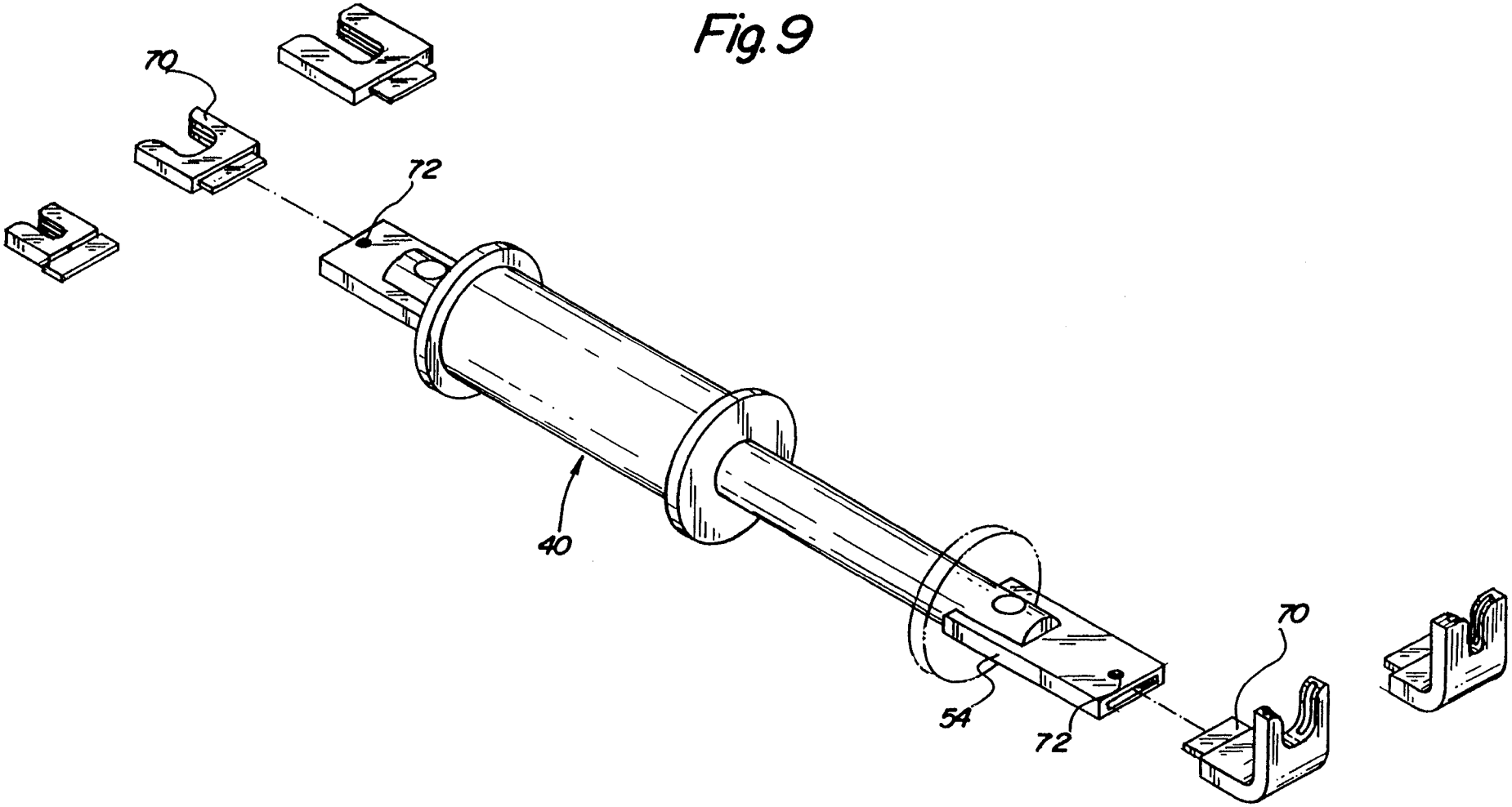
FIG. 9 is a perspective view of a further alternate embodiment of the present invention showing an example of a removeably secured contact member.

FIG. 9 a still further embodiment of the invention wherein the first end of the L-shaped member comprises a removeably secured contact member 70. The contact member is attached to the first end with a screw 72. The removeably secured contact member comprises a plurality of various sized members selectable for use with a variety of fastening member sizes and shapes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A new and improved hand tool for applying a staple into a supporting surface so as to secure an elongated cable on the supporting surface while allowing the user complete visibility of the staple throughout the fastening process, comprising:

a rectangular, L-shaped member having a first end having a first contact portion formed as a U-shaped channel with opposed parallel recesses to receive a staple, a second end having a second contact portion formed as a U-shaped channel with opposed parallel recesses to receive a staple, and an intermediate portion therebetween, the intermediate portion being bent offset from its center thereby forming a curvature for creating the L-shape with the regions at the curvature constituting surfaces for receiving strikes to propel the tool toward the supporting surface to thereby secure a staple into the supporting surface.

2. The tool according to claim 1 and further comprising a fastening member removal means for removing fasteners from a supporting surface, the removal means attached to and extending from the L-shaped member, forming a tapered upwardly curving point.

3. The tool according to claim 1, wherein at least one end of the L-shaped member comprises a removeably secured contact portion.

* * * * *